United States Patent [19]

Hein

[11] Patent Number: 4,781,381

[45] Date of Patent: Nov. 1, 1988

[54] STACKED SHEETS WITH CODE BITS FORMING COMPOSITE IMAGE

[76] Inventor: Ferdinand Hein, Schulestrasse 9, Augsburg, Fed. Rep. of Germany

[21] Appl. No.: 899,478

[22] Filed: Aug. 22, 1986

Related U.S. Application Data

[63] Continuation-in-part of Ser. No. 665,788, Oct. 29, 1984, abandoned.

[51] Int. Cl.[4] ..... A63F 9/12
[52] U.S. Cl. ..... 273/157 A
[58] Field of Search ..... 273/157 A

[56] References Cited

U.S. PATENT DOCUMENTS

| | | | |
|---|---|---|---|
| 2,280,609 | 4/1942 | Williamson | 273/157 A UX |
| 2,556,798 | 6/1951 | Concordet | 273/157 A UX |
| 2,577,320 | 12/1951 | Fenyo | 273/157 A UX |
| 3,510,134 | 5/1970 | Brooks et al. | 273/157 A X |
| 4,180,268 | 12/1979 | Brooks | 273/153 R |

*Primary Examiner*—Anton O. Oechsle
*Attorney, Agent, or Firm*—Lilling & Greenspan

[57] ABSTRACT

The three-dimensional puzzle consists of a plurality of transparent sheets on which code bits of information are arranged. When viewed in the correct direction, the code bits of information define a two-dimensional picture or object. When viewed from any other direction, the code bits appear as a jumbled image, and the hidden object is not apparent.

3 Claims, 2 Drawing Sheets

STACKED SHEETS WITH CODE BITS FORMING COMPOSITE IMAGE

This application is a continuation-in-part of application Ser. No. 665,788, filed Oct. 29, 1984, abandoned.

FIELD OF THE INVENTION

The invention involves a three-dimensional object with a plurality of transparent sheets on which code bits are arranged. When viewed from a specific angle of view, the code bits appear to combine in order to define a two-dimensional figure, whereas, when viewed from other directions, the code bits appear in a haphazard arrangement with no particular form.

BACKGROUND OF THE INVENTION

Puzzle pictures are known in many different forms. As a rule, these puzzle pictures are two dimensional and have essential and non-essential code bits arranged in certain patterns over the surface of the puzzle. When viewed from certain angles, the essential code bits dominate, and the figure or picture is viewable. If viewed from any other angle, the non-essential code bits combine with the essential code bits in order to block out the figure or picture.

SUMMARY OF THE INVENTION

The present invention involves a puzzle picture in which the figure or picture is hidden in a manner different from that known in the prior art. The puzzle picture itself is a three-dimensional object which comprises a plurality of translucent sheets. The code bits of information are arranged on each of the translucent sheets. When the translucent sheets are stacked in the correct order to form the three-dimensional object and are viewed in the correct direction, the code bits appear to merge together in order to define the figure or picture. When the three-dimensional object is viewed from any other direction or, if the translucent sheets are stacked in the incorrect order, the code bits appear as unordered, lines, dashes, etc., and no figure or picture is recognizable.

An essential feature of the present invention is, therefore, the plurality of the puzzle picture and the unaccustomed rethinking on the part of the observer from the three-dimensional arrangement of the code bits to the two-dimensional information or figure.

The invention is preferably a transparent cube consisting of a plurality of laminations of glass or plastic plates on which the code bits are arranged in the form of graphic elements such as dots, dashes and the like. The code bits are arranged on each plate in the required manner. The observer can only recognize on each plate a jumbled mass of code bits of meaningless information. Even when the plates are stacked together, the code bits on all plates appear only as a jumbled mass. The observer is only able to see the information when the plates are stacked in the correct order and rotational position and when the complete object is viewed from a precise angle or spatial direction. This means that the hidden information or figure is only clearly recognizable with one eye of the observer.

As required information, optional picture content such as a text, a telephone number, a graphic design, a photo or any other two-dimensional information can be hidden in the puzzle.

All code bits are part of the required information or figure. Therefore, it is not necessary to differentiate or separate important from unimportant code bits. Discovery of the hidden information follows a different interesting search principle in that all the code pieces must be fitted together to form the required information, as opposed to blocking out the unimportant code bits as would be typical in the prior art puzzles.

To use the invention as a toy, the transparent plates can be arranged in a housing or frame or a transparent container so as to permit removal of the plates and arranging them in different patterns. It may take many attempts before the plates are arranged in the correct order and orientation, so that the desired information or figure can be seen from the correct viewing direction.

In a variant of the present invention, the display of a digital indication, such as time, temperature or the like, may be used to form the three-dimensional puzzle. The digital indication could then be read only from a certain viewing direction, while from all other viewing directions only the scattered individual elements of the digital display (the code bits) appear, but not the digital indication itself (the information).

All data and features disclosed in the documents, in particular, the three-dimensional realization illustrated in the drawings, are claimed as essential to the invention insofar as they are, singly or in combination, novel relative to the state of the art.

BRIEF DESCRIPTION OF THE DRAWINGS

The invention will be further explained by means of several drawings which illustrate the invention in its preferred form.

FIG. 1*a* shows the information as broken down into its component code bits.

DETAILED DESCRIPTION OF THE INVENTION

Figure 1:
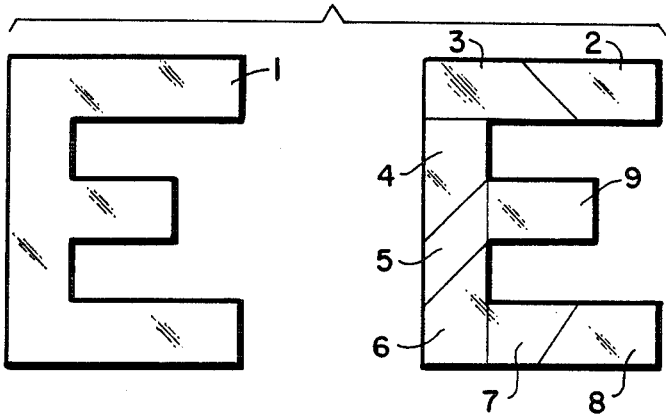
FIG. 1 shows an example of information that would be hidden by the puzzle.

Any figure or picture can be hidden in the puzzle of this invention. For purposes of illustration, the drawings will show how the letter "E" (FIG. 1) can be hidden in the puzzle. Any two-dimensional picture or figure can be broken down into any number of code bits, as is illustrated in FIG. 1*a* with regard to the letter "E". These code bits can have any form, such as squares, triangles, dots, dashes, arrows, etc. As shown in figure, the figure, which comprises the letter "E", is broken down into eight code bits 2–9.

Figure 2:
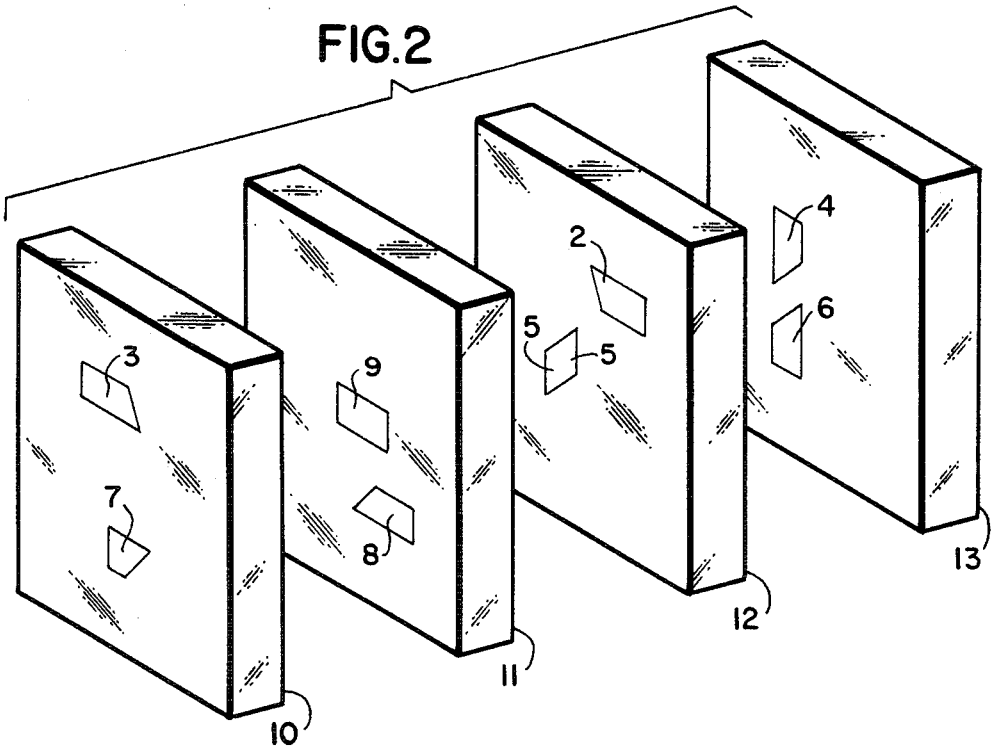
FIG. 2 is an exploded view showing the transparent plates on which the code bits are distributed.

FIG. 2 illustrates one manner in which the code bits 2–9 can be distributed on the surfaces of various translucent or transparent sheets or plates 10–13. As an example, in the drawings the code bits are shown as distributed on four plates 10–13, but it can be appreciated that any number of translucent or transparent plates may be used.

Figure 3:
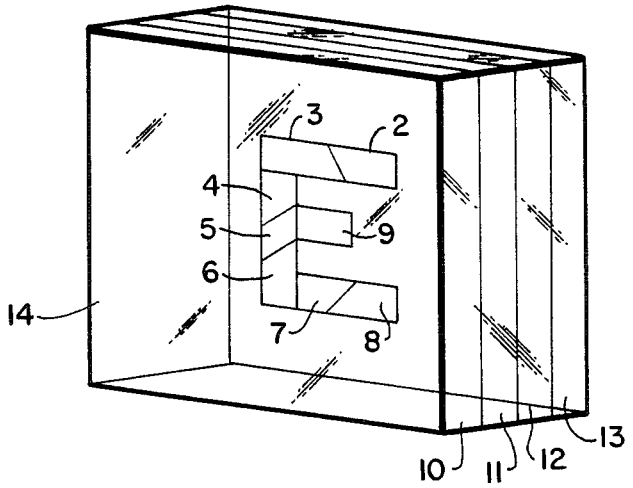
FIG. 3 is a perspective view showing the puzzle viewed from the correct direction.

The transparent plates 10–13 are combined together to form a three-dimensional puzzle 14, as best shown in FIG. 3. If desired, a frame or housing (not shown) can be used to hold the plates together. In other embodiments, the plates may be held together by glue or any suitable adhesive material.

Figure 4:
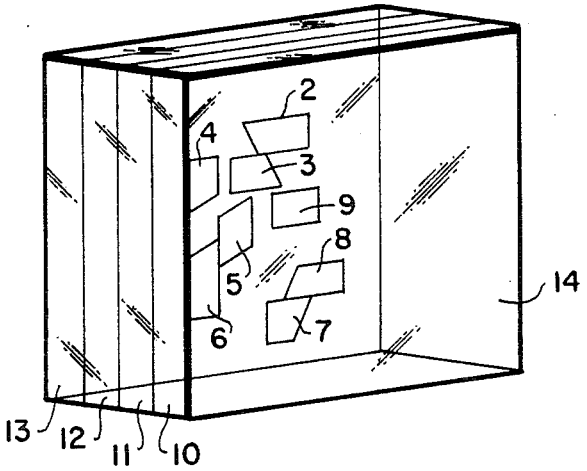
FIG. 4 is a perspective view similar to FIG. 3, but viewed from the incorrect angle of view.

If each individual plate or sheet is considered, it will be apparent that the code bits appearing on that single plate or sheet form an unrecognizable pattern. Further, if the three-dimensional puzzle 14 is viewed from any angle of view, other than the correct one, the code bits 29 appear as a confused or disorganized picture and the hidden figure information is not recognizable (See FIG. 4). When the three-dimensional puzzle 14 is viewed from the correct angle, the code bits 2–9 appear in proper relationship, and the hidden information 1 is readily apparent to the viewer (See FIG. 3). As can be seen in FIG. 3, the correct viewing angle is a perspective angle which is not perpendicular or normal to the major surfaces of the stacked sheets. In other words, the correct viewing angle is other than normal to the stacked array of sheets.

When the four plates or sheets 10–13 are stacked together in the correct order and orientation to form the three-dimensional puzzle 14, it is then dependent on the angle of view of the observer as to whether the information is recognizable or not. FIG. 3 shows the puzzle 14 from the angle of view in which the code bits 2–9 appear as coordinated information, and the hidden information or picture is visible. This angle of view is spatially very limited so that the information can only be clearly recognized with one eye and only at a specific distance of the eyes from the puzzle 14. From all other angles of view, the code bits appear as an uncoordinated jumble to the observer, as is apparent from FIG. 4.

A feature of the invention is that the plates or sheets have a finite thickness which therefore form a three-dimensional object when stacked, and thus the information in the form of code bits is distributed over all three dimensions. The transparent sheets have thicknesses approximating the linear dimensions of the code bits in planes parallel to the transparent sheets. The code bits 2–9 themselves are two-dimensional, as is the hidden information. It is also pointed out that each hidden figure or picture can be broken up into many different combinations of code bits, and the code bits themselves can be arranged in many different patterns on the sheets or plates.

The code bits can be produced by a printing process on the plates, such as by screen-printing, or by a photomechanical reproduction process. The manner in which to imprint the code bits on the transparent or translucent plates is known in the art. Additionally, it will be appreciated that the same or similar effect(s) can be obtained by embedding the code elements or bits within the transparent plates.

It may also be appreciated that in some embodiments it may be desirable for the bottom-most plate 13 to be opaque. In some embodiments it will be desirable to surround the three-dimensional puzzle 14 with an opaque housing.

I claim:

1. A three-dimensional puzzle comprising: a plurality of transparent sheets; code bits of information distributed on said plurality of transparent sheets; wherein said plurality of transparent sheets are stacked together to define a three-dimensional puzzle, said transparent sheets having thicknesses on the order of the linear dimensions of said code bits in planes parallel to said transparent sheets, whereby a composite image is defined by said code bits when viewed from a single precise angle of view other than normal to the stacked sheets composite image is not apparent when the three-dimensional puzzle is viewed from other angles of view.

2. A three-dimensional puzzle in accordance with claim 1, wherein said transparent plates can be turned and mixed together.

3. A three-dimensional puzzle according to claim 1, wherein said code bits are embedded in said transparent plates.

* * * * *